US012151868B2

(12) United States Patent
Wolf et al.

(10) Patent No.: US 12,151,868 B2
(45) Date of Patent: Nov. 26, 2024

(54) BULK CONTAINER HAVING STEEL OVERPACK

(71) Applicant: ENTEGRIS, INC., Billerica, MA (US)

(72) Inventors: Raymond Wolf, Chaska, MN (US); Dale A. Maenke, Chaska, MN (US); Jacob Littfin, Norwood, MN (US); John M. Hennen, Minong, WI (US)

(73) Assignee: ENTEGRIS, INC., Billerica, MA (US)

( * ) Notice: Subject to any disclaimer, the term of this patent is extended or adjusted under 35 U.S.C. 154(b) by 317 days.

(21) Appl. No.: 17/790,066

(22) PCT Filed: Dec. 23, 2020

(86) PCT No.: PCT/US2020/066832
§ 371 (c)(1),
(2) Date: Jun. 29, 2022

(87) PCT Pub. No.: WO2021/138192
PCT Pub. Date: Jul. 8, 2021

(65) Prior Publication Data

US 2023/0043590 A1 Feb. 9, 2023

Related U.S. Application Data

(60) Provisional application No. 62/956,448, filed on Jan. 2, 2020.

(51) Int. Cl.
*B65D 77/06* (2006.01)
*B65D 81/20* (2006.01)
(Continued)

(52) U.S. Cl.
CPC ..... *B65D 81/20* (2013.01); *B65D 77/06* (2013.01); *B65D 88/06* (2013.01); *B65D 90/10* (2013.01); *B65D 90/36* (2013.01)

(58) Field of Classification Search
CPC ..... B65D 77/06; B65D 81/20; B65D 88/06; B65D 90/10; B65D 90/36
(Continued)

(56) References Cited

U.S. PATENT DOCUMENTS 3,876,115 A * 4/1975 Venus, Jr. ..... B65D 83/0061 222/386.5
4,312,961 A 1/1982 Winegar
(Continued)

FOREIGN PATENT DOCUMENTS

JP 2008062950 A 3/2008
TW I624409 B 5/2018
(Continued)

*Primary Examiner* — Luan K Bui

(57) ABSTRACT

A fire-safe container includes a polymer polymeric IBC within a metal overpack. The metal overpack includes a manway surrounding a plurality of ports. Each port is on a projection form the polymeric IBC that extends into the manway through an aperture. A collar is disposed in each aperture between the projection of the polymeric IBC and the sides of the aperture such that the port is retained in the manway and preventing the port from contacting or collapsing through the aperture. The manway includes a burst disc to release pressure when there is pressure buildup. One of the ports can provide another burst disc to relieve pressure in the polymeric IBC. The polymeric IBC burst disc can release at a pressure that is greater than the pressure at which the manway burst disc releases.

19 Claims, 4 Drawing Sheets

(51) Int. Cl.
*B65D 88/06* (2006.01)
*B65D 90/10* (2006.01)
*B65D 90/36* (2006.01)

(58) Field of Classification Search
USPC ..... 206/524.8; 220/495.01, 495.04, 495.05, 220/495.06; 222/464.1, 581, 586
See application file for complete search history.

(56) References Cited

U.S. PATENT DOCUMENTS

| | | | | |
|---|---|---|---|---|
| 4,531,656 | A | 7/1985 | Nitchman | |
| 5,046,638 | A | 9/1991 | Wolf | |
| 5,887,750 | A | 3/1999 | Popp | |
| 5,899,362 | A | 5/1999 | Moran | |
| 6,571,972 | B1 | 6/2003 | Bouc | |
| 8,313,821 | B2 | 11/2012 | Yan | |
| 9,062,828 | B2 | 6/2015 | Tom | |
| 9,211,993 | B2 | 12/2015 | Tom | |
| 2003/0038147 | A1* | 2/2003 | Rauworth | B65D 51/1616 222/464.1 |
| 2008/0245676 | A1 | 10/2008 | McManus | |
| 2008/0298727 | A1 | 12/2008 | Edgington | |
| 2011/0266284 | A1* | 11/2011 | Schmidt | B65D 25/16 220/495.06 |
| 2013/0284760 | A1* | 10/2013 | Orr | B65D 83/0061 222/105 |
| 2015/0298960 | A1* | 10/2015 | Hennen | B67D 7/0288 29/428 |
| 2016/0229679 | A1 | 8/2016 | Ware | |
| 2017/0275093 | A1* | 9/2017 | Oltman | B65D 90/14 |
| 2019/0382178 | A1 | 12/2019 | Weyrauch | |

FOREIGN PATENT DOCUMENTS

| | | | |
|---|---|---|---|
| WO | 0242173 | A1 | 5/2002 |
| WO | 2012135266 | A2 | 10/2012 |

* cited by examiner

BULK CONTAINER HAVING STEEL OVERPACK

CROSS REFERENCE TO RELATED APPLICATION

This application is the U.S. National Stage of International Application No. PCT/US2020/066832, filed Dec. 23, 2020, which claims the benefit of and priority to U.S. Provisional Application No. 62/956,448 filed on Jan. 2, 2020, which is incorporated herein by reference in its entirety for all purposes.

TECHNICAL FIELD

This disclosure is directed to polymeric intermediate bulk containers having a protective overpack to provide enhanced safety and fire protection features.

BACKGROUND

Many intermediate bulk containers for chemicals, including volatile chemicals, are composed of polymer materials that do not offer desired safety and fire protection characteristics. Many fire safety and storage standards now require increased standards for heat resistance and deformation resistance, such as DOT 31A and UN standards, NFPA 30 standards for class 1B flammable liquids, and the like. Metal container options may be available. However, certain industries, such as the semiconductor industry, require the delivery of chemicals with high levels of purity. Metal bulk chemical containers may possess chemicals that become contaminated and less pure simply based on the interaction with the storage medium.

SUMMARY

This disclosure is directed to polymeric intermediate bulk containers having a protective overpack to provide enhanced safety and fire protection features.

By providing a steel overpack surrounding a polymeric intermediate bulk container (IBC), a container according to an embodiment can combine the chemical resistance and non-contaminating nature of the polymeric IBC with the resistance to heat and deformation of the overpack. The design of the overpack allows the contents of the IBC to be accessed through ports provided on the polymeric IBC, while protecting those ports within a manway. The ports are protected from damage through a mechanical interface with the overpack such as collars. The collars further retain the ports within the manway using a seal, to prevent the ports from being displaced in case, for example, removal of the contents of the polymeric IBC creates a low-pressure or vacuum condition. One-piece seals are provided to fully seal the polymeric IBC from an ambient environment of the bulk container. The manway and the polymeric IBC also include burst discs to release pressure at selected thresholds to improve the fire safety of the overall container and preventing dangerous levels of pressure buildup. These features provide a highly heat- and pressure-resistant bulk container that will satisfy tightening fire safety standards. Further, the overpack can be used to contain existing IBCs, allowing existing IBCs to be retrofitted to meet such standards and provide such improved safety.

In an embodiment, an overpack includes an overpack body having an open end, a closed end, and a lip surrounding the open end. The overpack also includes a cover. The cover includes a plurality of apertures and a manway surrounding the plurality of apertures. The manway includes a domed lid, a cylindrical side wall, and a flow passage extending through the cylindrical side wall including a burst disk configured to release pressure above a predetermined pressure. The container further includes a plurality of collars, each collar including a first portion received within one of the plurality of apertures and a lip that is larger than the aperture receiving the collar.

In an embodiment, the overpack body includes a metal or metal alloy.

In an embodiment, each of the plurality of collars includes a plurality of pieces that form a continuous ring when joined together.

In an embodiment, each of the collars comprises a polymer material having a static dry versus steel coefficient of friction of approximately 0.3 or less in accordance with ASTM D1894-140.

In an embodiment, each of the collars includes a channel formed in an inner surface of the collar. In an embodiment, the overpack further includes a seal disposed in the channel of each of the collars.

In an embodiment, each of the apertures has a chamfer, a bevel, or a rounded corner at the perimeter of the aperture.

In an embodiment, the overpack further includes a spring-assisted hinge joining the domed lid to the cylindrical side wall of the manway.

In an embodiment, the overpack further includes a first gasket disposed between the cover and the lip. In an embodiment, the overpack further includes a second gasket disposed between the domed lid and a top surface of the cylindrical side wall.

In an embodiment, the predetermined pressure of the burst disk is at or about 9 psi.

In an embodiment, a container system includes a polymeric intermediate bulk container (IBC) and an overpack. The polymeric IBC includes an IBC body defining a storage space, a plurality of projections at an end of the IBC body, and a port provided on each of the plurality of projections, the ports each in fluid communication with the storage space. The overpack surrounds the polymeric IBC and includes an overpack body having an open end, a closed end, and a lip surrounding the open end and a cover. The cover includes a plurality of apertures, and a manway surrounding the plurality of apertures. The manway includes a domed lid, a cylindrical side wall, a flow passage extending through the cylindrical side wall including a burst disk configured to release pressure above a predetermined pressure. The container system further includes a plurality of collars, each collar received within one of the plurality of apertures. Each of the projections extends through a corresponding one of each of the apertures such that each of the ports disposed on each projection is disposed within the cylindrical side wall of the manway. Each of the collars is disposed between an inner surface of a corresponding one of each the apertures and an outer surface of the projection extending through the aperture.

In an embodiment, the IBC body comprises a fluoropolymer.

In an embodiment, the container system further includes a plurality of shock pads configured to contact both the IBC body and an inner surface of the main body of the overpack.

In an embodiment, at least one of the ports includes a port burst disc. In an embodiment, the port burst disc is configured to release pressure at a pressure that is greater than the predetermined pressure of the overpack burst disc. In an embodiment, the port burst disc is configured to release pressure at a pressure that between approximately 15 psi and approximately 17 psi.

In an embodiment, each of the collars includes a channel formed on an inner surface of said collar, and a seal disposed in each of the channels. Each of the seals contacts one of the projections of the polymeric IBC.

In an embodiment, each of the plurality of collars comprises a plurality of pieces that form a continuous ring when joined together.

DRAWINGS

The disclosure may be more completely understood in consideration of the following description of various illustrative embodiments in connection with the accompanying drawings.

Figure 1:
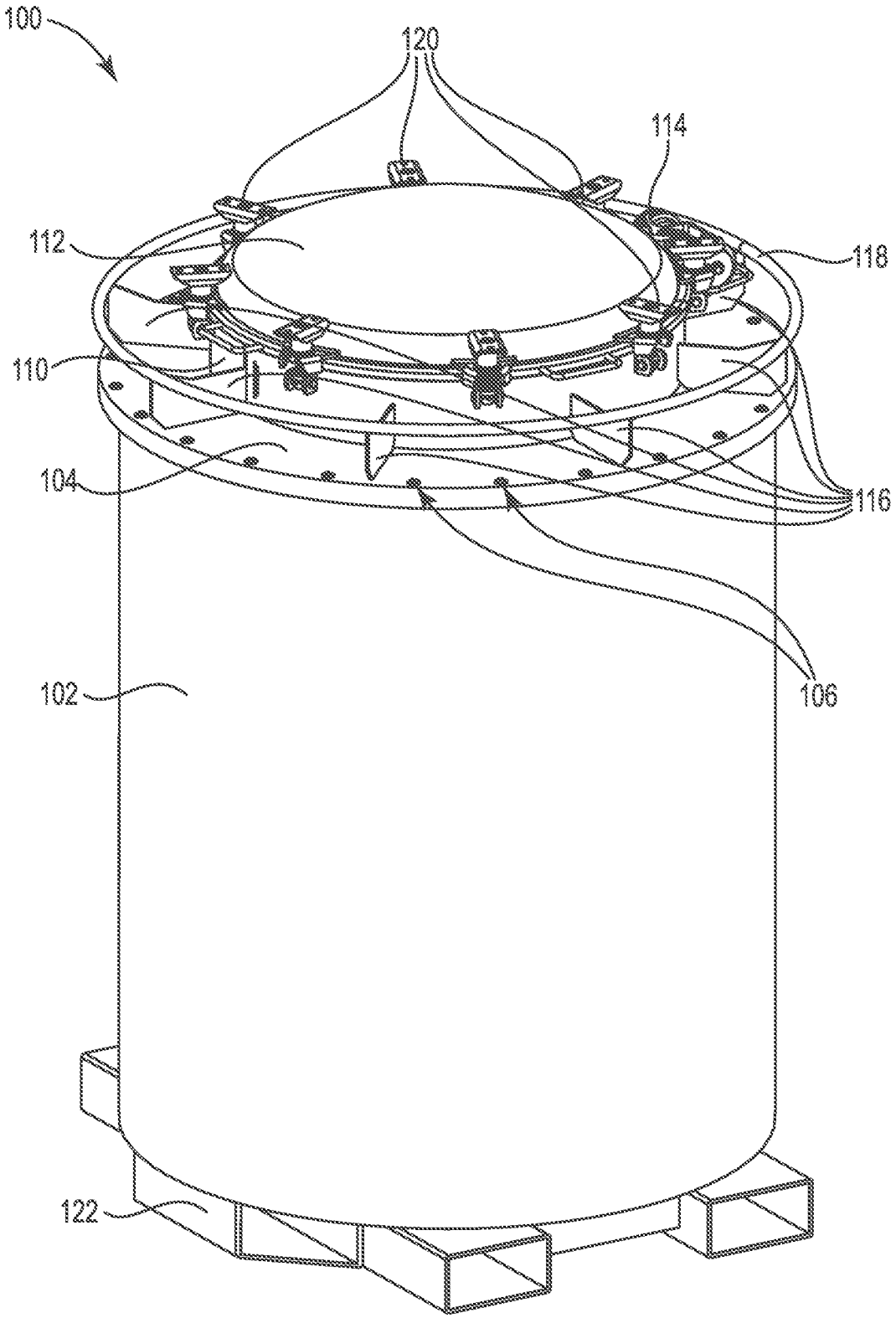
FIG. 1 shows a perspective view of an overpack according to an embodiment.

While the disclosure is amenable to various modifications and alternative forms, specifics thereof have been shown by way of example in the drawings and will be described in detail. It should be understood, however, that the intention is not to limit aspects of the disclosure to the particular illustrative embodiments described. On the contrary, the intention is to cover all modifications, equivalents, and alternatives falling within the spirit and scope of the disclosure.

DETAILED DESCRIPTION

The following detailed description should be read with reference to the drawings in which similar elements in different drawings are numbered the same. The detailed description and the drawings, which are not necessarily to scale, depict illustrative embodiments and are not intended to limit the scope of the invention. The illustrative embodiments depicted are intended only as exemplary. Selected features of any illustrative embodiment may be incorporated into an additional embodiment unless clearly stated to the contrary.

This disclosure is directed to intermediate bulk containers (IBCs) including an overpack to provide improved fire safety and combination of a polymeric IBC with the overpack.

Polymeric IBCs provide significant advantages for chemical storage due to their chemical resistance and lack of reaction with their contents, particularly for storage of highly reactive chemicals. However, polymeric IBCs can be dangerous in fire conditions, deforming due to heat and pressure and potentially releasing their contents. Since IBCs typically are housed together, this can lead to chain reactions and large risk of loss and damage as successive releases of volatile chemicals further spread or intensify fires. In contrast, metal containers are more robust to heat and pressure and provide a greater degree of fire safety. However, metal IBCs can be limited in chemical storage applications due to reactivity with the contents of the container, damaging the container or fouling the stored chemicals. Exposed polymer material can be subject to the deformation or destruction due to fire. Further, any contact between metal and stored chemical can provide a point of corrosion or introduce contamination into the stored chemical. Also, the interface between a plastic and a metal can cause damage to the plastic or particle generation that can contaminate the stored chemical. A metal overpack that surrounds a polymeric IBC, where the polymeric IBC includes projections into a manway of the overpack can provide the strength and heat resistance of a metal container while ensuring that only a polymeric IBC contacts the stored chemical. The projections of the polymeric IBC can enter the manway through collars so that they do not contact the metal of the overpack, providing clean and secure contact between the projections and the overpack.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The term "about" generally refers to a range of numbers that is considered equivalent to the recited value (e.g., having the same function or result). In many instances, the term "about" may include numbers that are rounded to the nearest significant figure.

Numerical ranges expressed using endpoints include all numbers subsumed within that range (e.g. 1 to 5 includes 1, 1.5, 2, 2.75, 3, 3.80, 4 and 5).

For the purposes of this disclosure, the following terms have the meanings provided below:

"Overpack" means a container at least partially surrounding an IBC that protects the IBC from external factors and circumstances that could adversely impact the IBC or its contents. The overpack does not directly contact contents of the IBC, but rather selectively allows access to the IBC such that the IBC can be filled or emptied.

"Intermediate bulk container (IBC)" means a container for storage of a material. In embodiments, IBCs can include (i) a single container such as a molded polymeric container, (ii) a metal overpack surrounding a polymer liner, (iii) a polymer overpack surrounding a polymer liner, (iv) a metal overpack surrounding a metal liner, or (v) any other form of such containers recognized by those having skill in the art.

"Polymeric intermediate bulk container" means a container made of a polymer used as an intermediate bulk container for storage of a chemical material. The polymeric IBC can be a preexisting IBC or a liner particularly designed to fit within an overpack.

Turning now to FIG. 1, FIG. 1 shows a perspective view of an overpack 100 according to an embodiment. Overpack 100 includes an overpack body 102 and a cover 104. Cover 104 is secured to overpack body 102 at a plurality of fastening points 106. Cover 104 includes a manway 108 that includes a lid 112 and a side wall 110 extending from an upper surface of the cover 104. Lid 112 is joined to the side wall 110 by a hinge 114. Gussets 116 extend from side wall 112 to rail 118. Lid 112 can be secured to the side wall 110 using mechanical fasteners 120. Overpack 100 can further include a base 122.

Overpack 100 is an overpack for an intermediate bulk container (IBC), for example an IBC used for storage of a chemical. Overpack 100 can surround the IBC completely. The IBC can be a preexisting IBC placed within overpack 100 or a polymeric IBC designed for use with the overpack 100.

Overpack body 102 defines an internal space of the overpack 100. Overpack body 102 can be any suitable shape defining a volume in which a material can be stored. In an embodiment, overpack body 102 can be shaped to accommodate an IBC within the overpack body 102. In an embodiment, overpack body 102 is cylindrical in shape. In an embodiment, the space within overpack body 102 is cylindrical. In an embodiment, a polymeric IBC can be dropped into or lifted out of the overpack body 102. The overpack body 102 can be made from a non-flammable, temperature resistant material. The overpack body 102 can further be a material having sufficient mechanical strength to resist deformation. In an embodiment based on the intended application, overpack body can resist deformation at, as a non-limiting example, pressures of up to 17 psi.

Overpack 100 including overpack 102 body can include one or more metals or alloys, such as steel. In an embodiment, the one or more metals include stainless steel or carbon steel. In an embodiment, the one or more metals includes 304 stainless steel. In an embodiment, the one or more metals includes a carbon steel combined with a protective coating such as a paint or any other surface treatment as recognized by those having skill in the art. In an embodiment, the walls of overpack body 102 are 7 gauge or a similar thickness.

The materials used and shapes and thicknesses of the overpack 100, overpack body 102 and various other components (e.g. cover 104, manway 108, sidewall 110, lid 112, etc.) can be selected to satisfy standards for temperature and pressure resistance ensuring compliance with standards for containers including DOT 31A, NFPA 30 for class 1B flammable liquids, and the like. These standards can include leak testing where no leaks are found at a pressure of 9 psi, a hydro test, a drop test, a lift test, and a vibration test. The DOT 31A standards can be found, for example, at 49 C.F.R. § 178.

Cover 104 is a cover for closing the overpack 100. Cover 104 can be joined to overpack body 102. Cover 104 can be steel, such as 304 stainless steel. In an embodiment, cover 104 is 7 gauge or a similar thickness. Cover 104 can have a shape corresponding to the shape of an open end of the overpack body 102. In an embodiment, cover 104 has a disc shape where overpack body 102 has a cylindrical shape. Cover 104 can be made of the same material as overpack body 102. Cover 104 can have the same thickness as the wall of overpack body 102.

Fastening points 106 allow mechanical fastening of cover 104 to overpack body 102. The fastening points 106 can be points for the attachment of any suitable mechanical connector, such as bolts or screws. The fastening points can each include holes in the overpack body 102 and cover 104 allowing a bolt to be inserted, and a nut used to fix the cover 104 to the overpack body 102. The fastening points 106 can include features formed on a lip (not shown) extending radially outwards from the end of overpack body 102.

Manway 108 is located on cover 104. Manway 108 includes a side wall 110 and a lid 112. Manway 108 surrounds and protects points where the contents of overpack 100 can be accessed. Manway 108 can be centered on the cover 104.

Side wall 110 defines a space within which ports for accessing the contents of overpack 100 are contained. Side wall 110 extends vertically from the cover 104. In an embodiment, side wall 110 is a cylindrical side wall defining a cylindrical space.

Lid 112 is a lid sized to match or exceed the size of side wall 110 so that it can enclose manway 108 when closed. Lid 112 can be domed to improve pressure resistance without deformation. A seal can be disposed between the side wall 110 and the lid 112 such that the space inside manway 108 is sealed when lid 112 is secured to side wall 110. The seal can be a single continuous gasket. The seal can include a polymer material. In an embodiment, the polymer material of the seal is chemically resistant. In an embodiment, the polymer material of the seal is a thermoplastic elastomer or a thermoset polymer material. In an embodiment, the polymer material of the seal is a fluoropolymer. In an embodiment, the polymer material of the gasket is, as non-limiting examples, EPDM rubber or a fluoroelastomer or fluorocarbon rubber such as FKM. FKM is a family of fluoroelastomer materials defined by the ASTM International standard D1418.

Hinge 114 joins the lid 110 of manway 108 to the side wall 112. Hinge 114 can be, for example, a spring-assisted hinge reducing the force required to open lid 110 when mechanical fasteners 120 are in the release positions. One or more of the gussets 116 can include a cut-out positioned to accommodate the hinge 114.

Gussets 116 are provided on cover 104, extending from side wall 112 outwards towards an outer perimeter of cover 104. In an embodiment, each of the gussets 116 extends to the outer perimeter of cover 104. The gussets 116 can provide mechanical reinforcement to cover 104 to provide greater resistance to deformation due to pressure within overpack body 102. The gussets 116 can each have a height that is less than or equal to the height of side wall 112. The gussets can be evenly distributed around the side wall 112. In an embodiment, the overpack 100 can include between six and eight gussets 116. In an embodiment, each of the gussets 116 is joined to the cover 104 by a weld. In an embodiment, each of the gussets 116 is joined to the side wall 112 by a weld. In an embodiment, the number and arrangement of the gussets 116 is selected such that the lid can withstand a pressure of at least at or about 9 psi without deformation.

Rail 118 is joined to the gussets 116. Rail 118 provides mechanical support to the gussets 116, assisting the gussets 116 in providing reinforcement to cover 104. Rail 118 can have the same general shape as the cover 104. Rail 118 can have, for example, a ring shape. Rail 118 can have, for example, a circular cross-section. In an embodiment, rail 118 is joined to each of the gussets 116 by a weld. Rail 118 can protect other parts of overpack 100 from impacts during handing by being outwards of components such as the gussets 116 or manway 108.

Mechanical fasteners 120 can be used to fix lid 112 to side wall 110, closing manway 108. In an embodiment, the mechanical fasteners include T-bolts. In an embodiment, each of the T-bolts can include a bolt joined to the side wall 110 by a hinge and can interface with a catch joined to the lid 112. A nut can be threaded on each bolt such that it can press against one of the catches when screwed into place. The nut can include one or more projections to facilitate gripping and rotation of the nut. In an embodiment, between six and eight mechanical fasteners are used. In an embodiment, the mechanical fasteners 120 are distributed around the perimeter of the side wall 110 and the lid 112.

Base 122 is at an end of overpack body 102 opposite the cover 104. Base 122 can include features for interfacing with equipment to move or otherwise manipulate overpack 100, such as one or more channels to receive parts of a forklift.

Figure 2:
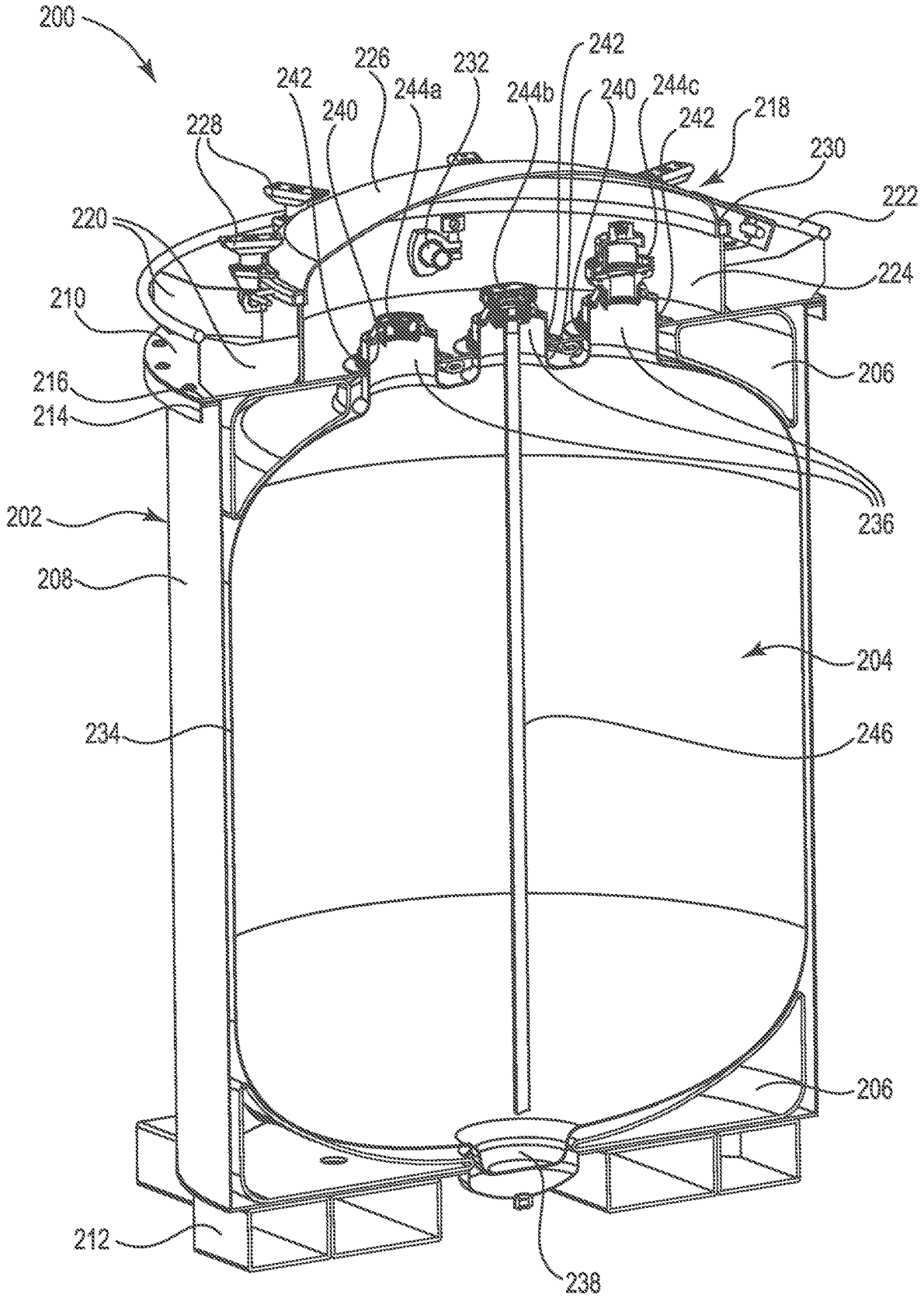
FIG. 2 shows a sectional view of a container according to an embodiment.

FIG. 2 shows a sectional view of a container according to an embodiment. Container 200 includes an overpack 202 and a polymeric intermediate bulk container (IBC) 204.

Shock pads 206 can fill spaces between the overpack 202 and the polymeric IBC 204. Overpack 202 includes overpack body 208, cover 210, and base 212. Overpack body 208 includes a lip 214, and a first seal 216 is disposed between the lip 214 and the cover 210. Cover 210 includes manway 218, gussets 220, and rail 222. Manway 218 includes a side wall 224 and a lid 226. The lid 226 can be closed by mechanical fasteners 228. A second seal 230 is disposed between the lid 226 and the side wall 224. The manway 218 also includes a fluid passage 232. The polymeric IBC 204 includes a polymeric IBC body 234 and projections 236. The polymeric IBC body 232 can include a well 238. The projections 236 extend through apertures 240 formed in the cover 210. The projections 236 are surrounded by collars 242 where they pass through apertures 240. Ports 244*a*, 244*b*, and 244*c* are positioned at the ends of the projections 236. Port 244*b* is shown including a dip tube 246 extending into IBC body 234.

Overpack 202 forms an exterior of container 200. Overpack 202 includes overpack body 208 and cover 210, with cover 210 including manway 218, and base 212 located at the end of overpack body 208 opposite cover 210. Overpack 202 can completely surround polymeric IBC 204 when lid 226 of manway 218 is closed. Overpack 202 can provide temperature resistance to the container 200. Overpack 202 can provide resistance to deformation due to pressure within the container 200. Overpack 202 can further protect polymeric IBC 204 from shocks or physical damage. Overpack 202 can be made of one or more metal or alloy materials. In an embodiment, overpack 202 includes 304 stainless steel.

Shock pads 206 can be placed within the overpack. Shock pads 206 can restrict movement of the polymeric IBC 204 within overpack 202. Shock pads 206 can further absorb shocks such as acceleration during handling of container 200 to reduce the transmission of those shocks to polymeric IBC 204. Two or more shock pads can be included within overpack 202, for example one shock pad 206 below the polymeric IBC 204 and another shock pad 206 above the polymeric IBC 204 and extending up to meet cover 210 when cover 210 is fixed to the overpack body 208. In an embodiment, the shock pads 206 can have a shape such that the shock pad 206 fills a space between the overpack 202 and polymeric IBC 204. The shock pads 206 can be made from a resilient material. In an embodiment, the resilient material is an elastomeric material, a thermoplastic elastomer, or another engineered material. In an embodiment, the resilient material is a thermoset polymer material. In an embodiment, the shock pads 206 include crosslinked polyethylene. Persons of skill in the art can recognize suitable shapes and sizes for shock pads 206 based on the shapes and sizes of overpack 202 and polymeric IBC 204.

Overpack body 208 defines an internal space to accommodate polymeric IBC 204, particularly IBC body 234. overpack body 208 can be any suitable shape defining a volume in which a material can be stored. In an embodiment, overpack body 208 can be shaped to accommodate polymeric IBC 204 and shock pads 206. In an embodiment, overpack body 208 is cylindrical in shape. The overpack body 208 can be made from a non-flammable, temperature resistant material. The overpack body 208 can further be a material having sufficient mechanical strength to resist deformation when exposed to pressures of up to 17 psi. Overpack body 208 can include a metal or alloy material. In an embodiment, overpack body 208 is entirely the metal or alloy material. overpack body 208 can be steel, such as 304 stainless steel. In an embodiment, overpack body 208 is 7 gauge or a similar thickness.

Cover 210 is a cover to enclose overpack body 208 at its open end. Cover 210 can be fixed to the overpack body 208 by mechanical fasteners at fastening points such as fastening points 106 described above and shown in FIG. 1. Manway 218 is located on cover 210, opposite the overpack body 208. Cover 210 includes apertures 240 allowing projections 236 of a polymeric IBC 204 to extend through the cover 210 into the manway 218. Cover 210 can have a shape corresponding to the open end of the overpack body 208. In an embodiment, cover 210 has a disc shape where overpack body 208 has a cylindrical shape. Cover 210 can be made of the same material as overpack body 208. Cover 210 can have the same thickness as the wall of overpack body 208. Cover 210 can be steel, such as 304 stainless steel. In an embodiment, cover 210 is 7 gauge or a similar thickness.

Base 212 is at an end of overpack body 208 opposite the open end where it is joined to cover 210. Base 212 can include features for interfacing with equipment to move or otherwise manipulate the container 200, such as one or more channels to receive parts of a forklift.

Lip 214 extends outwards from the overpack body 208 at the open end of the overpack body 208. Lip 214 can be a continuous flange surrounding the open end of the overpack body 208. Lip 214 can be sized such that it interfaces with the cover 210.

First seal 216 is disposed between the lip 214 of the overpack body 208 and the cover 210. In an embodiment, first seal 216 includes a polymer material. In an embodiment, the polymer material of first seal 216 is chemically resistant. In an embodiment, the polymer material of first seal 216 is a thermoplastic polymer material. In an embodiment, the polymer material is a fluoropolymer. In an embodiment, first seal 216 is a continuous gasket following the shape of lip 214 such that it can completely seal the joint between the lip 214 and the cover 210. In an embodiment, the first seal 216 is a circular flat gasket. In an embodiment, first seal 216 is disposed in a groove formed on a bottom side of the cover 210.

Manway 218 is located on cover 210. The manway 210 surrounds projections 236 from polymeric IBC 204 that extend through cover 210 at apertures 240. The manway 218 includes side wall 224 and lid 226. When lid 226 is closed, the manway 218 can contain the projections 236, protecting the polymeric IBC 204 and ports 244*a,b,c* from the environment surrounding the container 200. The manway 218 can further include a fluid passage 232 to allow release of pressure within the manway 218.

Gussets 220 are joined to the side wall 224 of the manway 218 and to the cover 210. Gussets 220 provide reinforcement to the cover 210, for example to reduce or prevent deformation of cover 210 under high pressure. In an embodiment, each of the gussets 220 extends to the outer perimeter of cover 210. The gussets 220 can each have a height that is less than or equal to the height of side wall 224. The gussets can be evenly distributed around the side wall 224. In an embodiment, the overpack 202 can include between six and eight gussets 220 on cover 210. In an embodiment, each of the gussets 220 is joined to the cover 210 by a weld. In an embodiment, each of the gussets 220 is joined to the side wall 224 by a weld.

Rail 222 is joined to the gussets 220. Rail 222 provides mechanical support to the gussets 220, assisting the gussets 220 in providing reinforcement to cover 210. Rail 222 can have the same general shape as the cover 210. Rail 222 can have, for example, a ring shape. Rail 222 can have, for example, a circular cross-section. In an embodiment, rail 222 is joined to each of the gussets 220 by a weld.

Side wall 224 extends vertically from cover 210. Side wall 224 defines a space containing projections 236 and ports 244*a,b,c*. Side wall 224 can be, for example, a cylindrical side wall defining a cylindrical space. Side wall 224 can be concentric with cover 210. The height of side wall 224 can be greater than the height of the tallest of the ports 244*a,b,c* that are within the manway 218. Side wall 314 can be steel, such as 304 stainless steel. In an embodiment, side wall 314 is 7 gauge or a similar thickness.

Lid 226 is a lid sized to cover an end of side wall 224 to enclose the manway 2178. Lid 226 can match or exceed the size of side wall 224 so that it can enclose manway 218 when closed and fixed to side wall 224. Lid 226 can be domed to improve pressure resistance without deformation.

Mechanical fasteners 228 can be used to fix lid 226 to side wall 224, closing manway 218. In an embodiment, the mechanical fasteners can be T-bolts as described above and shown in FIG. 1. In an embodiment, between six and eight mechanical fasteners are used. In an embodiment, the mechanical fasteners 228 are distributed around the perimeter of the side wall 224 and the lid 226.

A second seal 230 is disposed between the lid 226 and the side wall 224. The second seal 230 is sized and shaped to seal an interface between the lid 226 and the side wall 224. The second seal 230 can be any suitable seal for sealing the manway when lid 226 is secured to side wall 224. In an embodiment, second seal 230 is a single continuous gasket. In an embodiment, the second seal 230 includes a polymer material. In an embodiment, the polymer material of second seal 230 is chemically resistant. In an embodiment, the polymer material of second seal 230 is a thermoplastic polymer material. In an embodiment, the polymer material of second seal 230 is a fluoropolymer.

The manway 218 also includes a fluid passage 232. Fluid passage 232 is a passage through the side wall 214. Fluid passage 232 includes a flow restrictor that prevents the passage of fluid below a threshold pressure. The flow restrictor can be, for example, a burst disc. The threshold pressure at which fluid can be allowed to pass the flow restrictor can be, for example, at or about 9 psi. When the flow restrictor allows the passage of fluid, fluid within manway 306 such as pressurized gas can flow out of the manway 232 to the ambient environment through fluid passage 232.

Polymeric IBC 204 can be contained within overpack 202. Polymeric IBC 204 can provide a chemically resistant, clean environment, for example for chemical storage. Polymeric IBC 204 includes IBC body 234 and projections 236. Ports 244*a,b,c* can allow passage into or out of polymeric IBC 204. Polymeric IBC 204 can include one or more polymer materials. In an embodiment, polymeric IBC 204 can be made entirely of the one or more polymer materials. The at least one of the polymer materials can be a polymer material selected for compatibility with a chemical to be stored within container 200. Non-limiting examples of the polymer materials include polyolefins such as polyethylene (PE) or high-density polyethylene (HDPE), fluoropolymers such as perfluoroalkoxy alkane (PFA), or the like. The polymer material can be a melt-processable polymer material. In an embodiment, the polymeric IBC 204 includes PFA. In an embodiment, the polymeric IBC is composed entirely of PFA.

IBC body 234 defines a space within container 200 within which a chemical can be stored. When container 200 is assembled, IBC body 234 is disposed within overpack body 208 of overpack 202. IBC body 234 can occupy a majority of the volume within the overpack body 208 of overpack 202. IBC body 234 can have a generally cylindrical main portion with domed ends. IBC body 234 can contact at least a portion of the overpack body 208. IBC body 234 can be a single piece. IBC body 234 can be seamless. IBC body 234 can be removable from overpack 202.

Polymeric IBC 204 includes projections 236. The projections 236 extend out of the overpack body 208 of overpack 202 and are contained within manway 218. The projections 236 extend through apertures 240 formed in the cover 210. Projections 236 are portions of the polymeric IBC 204 contained within the overpack 202. Projections 236 each extend through one of the apertures 240 to protrude from the cover 210 into the manway 218. The apertures 240 are openings in the cover 210 that are surrounded by manway 218. The apertures each are sized such that the projections 236 can extend through the apertures 240. For example, the apertures 240 can have a diameter larger than that of the projections 236 when the apertures 240 have a generally circular shape and the projections 236 have a circular cross-section where they pass through the cover 210 into manway 218. The projections 236 can be the same material as the polymeric IBC 204, such as perfluoroalkoxy alkane or any other suitable material. In an embodiment, the projections 236 are formed in the seamless construction of IBC body 234, for example by being integrally molded. In an embodiment, the projections 236 are welded to the IBC body 234.

Well 238 can be formed at a bottom of IBC body 234 to collect stored chemical at low levels. In an embodiment, a drain or access can be provided in well 238 to facilitate emptying or cleaning the polymeric IBC 204. In an embodiment, overpack 202 can include a portion shaped to accommodate the well 238. In an embodiment, overpack 202 can allow access to the well 238.

The projections 236 are surrounded by collars 242 where they pass through apertures 240. Collars 242 surround the inner surface of the aperture 240 such that it cannot contact projection 236. Collar 242 has a shape generally following the shape of the aperture 240 that the collar 242 is located within. Collar 242 can include or be made entirely of one or more polymer materials. Non-limiting examples of polymer materials include Acetal copolymer (polyoxymethylene), polyethylene, high-density polyethylene, or the like. The polymer materials can be selected to provide low particle generation when contacting the polymeric IBC and the apertures of the overpack. The one or more polymer materials can include polymer materials having a low coefficient of friction to provide the low particle generation when contacting the overpack 202. At least one of the polymer materials can be selected for chemical resistance to a chemical contained within the polymeric IBC of the container 200. In an embodiment, the polymer material can be a polymer material having a static coefficient of friction (dry versus steel) of approximately 0.3 or less in accordance with ASTM D1894-140. Collars 242 can each have a one piece, clamshell, or multi-part structure. Collars 242 each can include a seal (not shown) disposed within the collar. The seal can contact the projection 236 passing through the collar 242 to provide friction resisting movement of the projection 236 through the aperture 240, for example due to the polymeric IBC collapsing as pressure reduces during the pressure or other downwards movement of the projection 236. The seal is shown in FIG. 4 and described in more detail below. The collars prevent the surfaces of apertures 240 from wearing the projections 236 while also retaining the projections such that ports 244*a,b,c* remain within the manway 218 and can be accessed when the lid 226 is opened.

Ports 244*a*, 244*b*, and 244*c* are positioned at the ends of the projections 236. One of the ports 244*a,b,c* is provided on each projection 236. Each of the ports 244*a,b,c* can allow passage of material into or out of the polymeric IBC 204. In an embodiment, one of the ports 244*a* allows insertion of a probe into the polymeric IBC. The probe can be, for example, a grounding probe to prevent static buildup during filling. The probe can be, for example, used the contents of the filter. In an embodiment, port 244*b* is a port for filling or removing material from the polymeric IBC 204. In an embodiment, one of the ports 244*b* can be in communication with a dip tube 246. The dip tube 246 can be used to facilitate filling or removal of a chemical within the polymeric IBC 204. In an embodiment, one of the ports 244*c* can be used for relief of pressure buildup within the polymeric IBC. This port can include a flow restrictor that only allows flow of a fluid through port 244*c* when the pressure is above a particular threshold pressure. In an embodiment, the flow restrictor is a burst disc. In an embodiment, the threshold pressure is between about 15 psi and about 17 psi.

Figure 3:
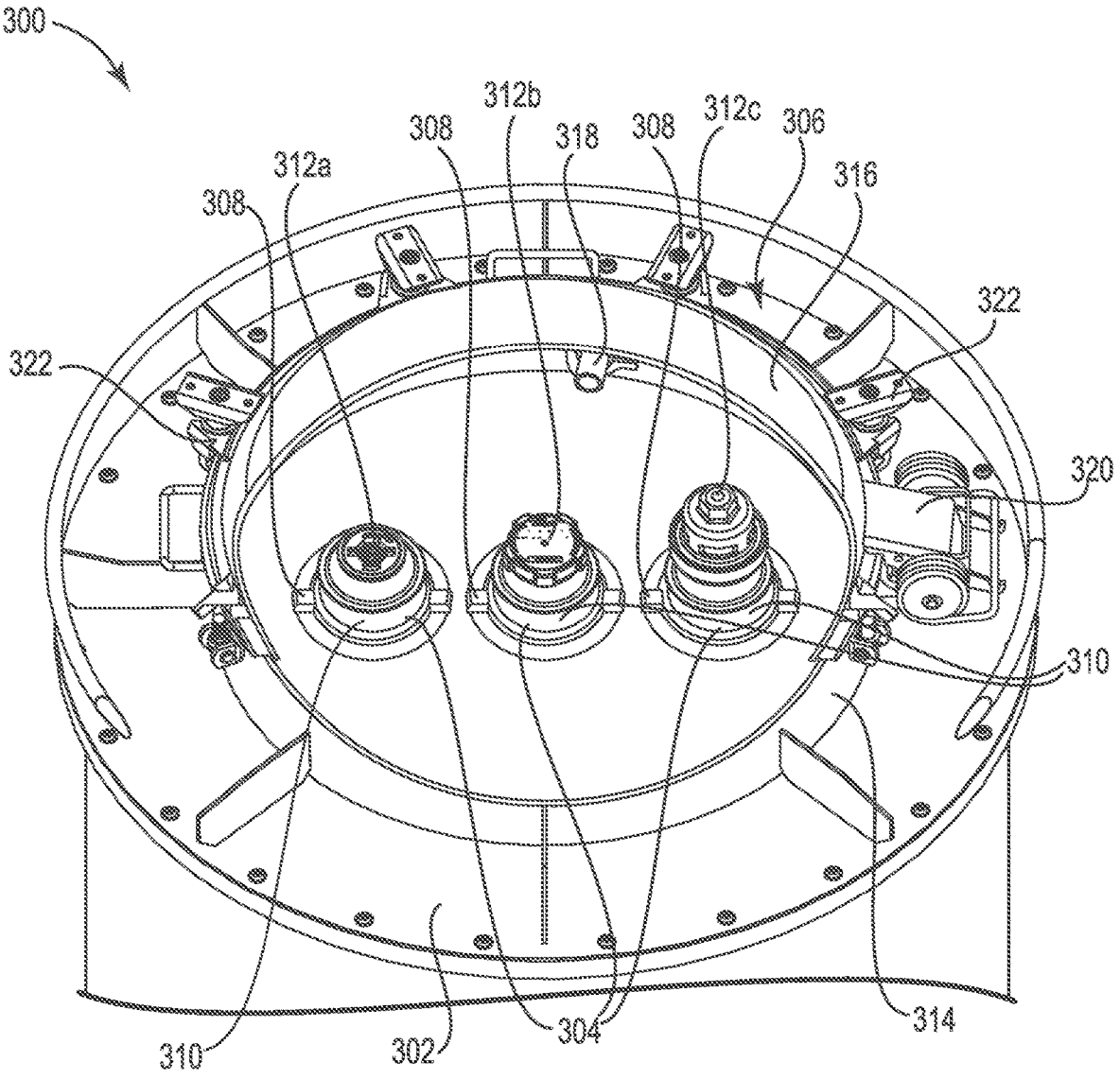
FIG. 3 shows a sectional view of a manway of a container according to an embodiment.

FIG. 3 shows a sectional view of a manway of a container according to an embodiment. Container 300 includes cover 302. The cover 302 includes apertures 304 and manway 306. Collars 308 are disposed in each of the apertures 304. Projections 310 of a polymeric IBC extend through the collars, presenting ports 312*a*, 312*b*, and 312*c* within the manway 306. The manway 306 includes a side wall 314 surrounding the ports 312*a,b,c* and a lid 316. The manway 306 also includes a fluid passage 318.

Cover 302 is a cover for closing the container 300. Cover 302 can be joined to an overpack body containing a polymeric IBC. Cover 302 can be steel, such as 304 stainless steel. In an embodiment, cover 302 is 7 gauge or a similar thickness. Cover 302 has a shape corresponding to the open end of the overpack body of container 300. In an embodiment, cover 302 has a disc shape. In an embodiment, cover 302 includes a plurality of gussets and a ring joining the gussets to provide structural support, as described above and shown in FIGS. 1 and 2. Cover 302 can be joined to the overpack body using mechanical fasteners such as, for example, bolts or screws at attachment points such as those described above and shown in FIGS. 1 and 2.

Apertures 304 are openings in the cover 302 allowing passage through the cover 302 into the manway 306. The apertures 304 are sized to be larger than the diameter of projections 310 where those projections would extend through the apertures 304. Surfaces of the apertures 304 can be smoothed, for example by buffing, polishing, grinding or the like to remove sharp corners at each of the apertures 304. The smoothed surfaces can be provided by including a chamfer or bevel around the edges of apertures 304. The apertures 304 are surrounded by side wall 314 of the manway 306. The apertures 304 can be distributed such that the apertures are arranged in a line. In an embodiment, one of the apertures 304 is at a center of the cover 302. In an embodiment, the aperture 304 at the center of cover 302 is the center of the line along which the apertures 304 are distributed.

Collars 308 surround each of the projections 310, and are disposed between the aperture 304 and the projection 310. Collars 308 surround the inner surface of the aperture 304 such that it cannot contact projection 310. Collar 308 has a shape generally following the shape of the aperture 304 that it is located within. Collar 308 can include or be made entirely of one or more polymer materials. Non-limiting examples of polymer materials include Acetal copolymer (polyoxymethylene), polyethylene, high-density polyethylene, or the like. The polymer materials can be selected to provide low particle generation when contacting the polymeric IBC and the apertures of the overpack. The one or more polymer materials can include polymer materials having a low coefficient of friction. At least one of the polymer materials can be selected for chemical resistance to a chemical contained within the polymeric IBC of the container 300. In an embodiment, the polymer material can a static coefficient of friction (dry versus steel) of approximately 0.3 or less in accordance with ASTM D1894-140. Collar 308 can have a one piece, clam-shell, or multi-part structure. Collar 308 can include a seal (not shown) disposed within the collar. The seal can contact the projection 310 to provide friction resisting movement of the projection 310 through the aperture 304, for example due to the polymeric IBC collapsing as pressure reduces during the pressure or other downwards movement of the projection 310. The seal is shown in FIG. 4 and described in more detail below. The collars prevent the surfaces of apertures 304 from wearing the projections 310 while also retaining the projections such that ports 312*a,b,c* remain within the manway 306 and can be accessed when the lid 316 is opened.

Projections 310 are portions of a polymeric IBC contained within the overpack. Projections 310 each extend through one of the apertures 304. The projections 310 can be the same material as the polymeric IBC, such as perfluoroalkoxy alkane or any other suitable polymeric IBC material.

Ports 312*a*, 312*b*, and 312*c* are provided on the projections 310. One of the ports 312*a,b,c* is provided on each projection 310. Each of the ports 312*a,b,c* can allow passage of material into or out of the polymeric IBC. In an embodiment, one of the ports 312*a* allows insertion of a probe into the polymeric IBC. The probe can be, for example, a grounding probe to prevent static buildup during filling. In an embodiment, port 312*b* is a port for filling or removing material from the polymeric IBC. In an embodiment, one of the ports 312*b* can be in communication with a dip tube, as described above and shown in FIG. 2. In an embodiment, one of the ports 312*c* can be used for relief of pressure buildup within the polymeric IBC. This port can include a flow restrictor that only allows flow of a fluid through port 312*c* when the pressure is above a particular threshold pressure. In an embodiment, the flow restrictor is a burst disc. In an embodiment, the threshold pressure is between about 15 psi and about 17 psi.

Manway 306 encloses the part of projections 310 extending through cover 302 at apertures 304 and the ports 312*a,b,c*. The manway 306 includes side wall 314 and lid 316. In manway 306, lid 316 can be joined to the side wall 314 by a hinge 320, such as a spring-assisted hinge to facilitate opening. Manway 306 can further include mechanical fasteners 322 such as T-bolts to secure the lid 316 to the side wall.

Side wall 314 surrounds the apertures 304. Side wall 314 can extend vertically from the cover 302. The side wall 314 can extend vertically to a height greater than the height that the projections 310 extend though the apertures 304. Side wall 314 can, for example, define a cylindrical space. Side wall 314 can be steel, such as 304 stainless steel. In an embodiment, side wall 314 is 7 gauge or a similar thickness.

Lid 316 is a lid sized to match or exceed the size of side wall 314 so that it can enclose manway 306 when closed, with ports 312*a,b,c* located within the enclosed manway 306. Lid 316 can be domed to improve pressure resistance without deformation. A seal can be disposed between the side wall 314 and the lid 316 such that the space inside manway 306 is sealed when lid 316 is secured to side wall 314. The seal can be a single continuous gasket.

Fluid passage 318 is a passage through the side wall 314. Fluid passage 318 includes a flow restrictor that prevents the passage of fluid below a threshold pressure. The flow restrictor can be, for example, a burst disc. The threshold pressure at which fluid can be allowed to pass the flow restrictor can be, for example, at or about 9 psi. When the flow restrictor allows the passage of fluid, fluid within manway 306 such as pressurized gas can flow out of the manway 318 to the ambient environment through fluid passage 318.

Figure 4A:
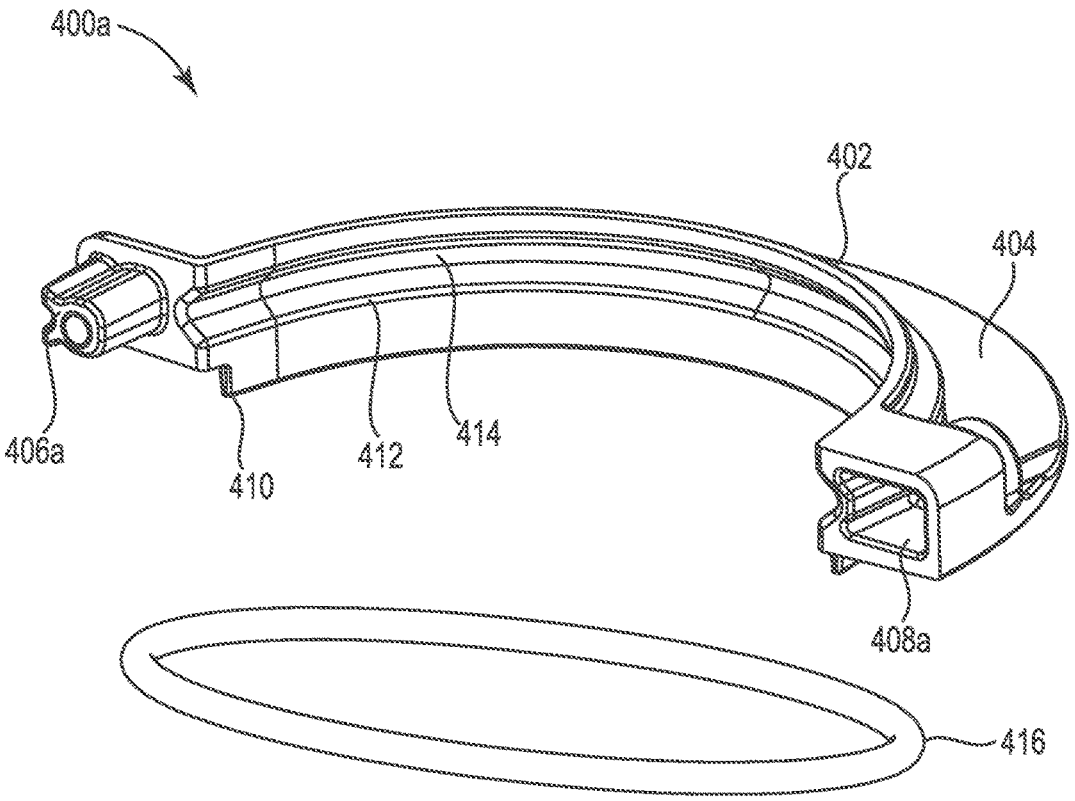
FIG. 4A shows a first view of a piece of collar according to an embodiment.

FIG. 4A shows a first view of a first collar segment 400*a* according to an embodiment. The first collar segment 400*a* includes a collar body 402, a retention flange 404 extending outwards from the collar body 402, an assembly projection 406*a*, and an assembly socket 408*a*. A vertical projection 410 extends from collar body 402. An inner surface 412 of collar body 402 has a groove 414 formed in it. A seal 416 can be placed in groove 414 before or after the collar is formed by joining collar segments 400.

Collar segments 400*a* can include or be made entirely of one or more polymer materials. Non-limiting examples of polymer materials include acetal copolymer (polyoxymethylene), polyethylene, high-density polyethylene, or the like. The polymer materials can be selected to provide low particle generation when contacting the polymeric IBC and the apertures of the overpack. The one or more polymer materials can include polymer materials having a low coefficient of friction. In an embodiment, the polymer material can a static coefficient of friction (dry versus steel) of approximately 0.3 or less in accordance with ASTM D1894-140. At least one of the polymer materials can be selected for chemical resistance to a chemical contained within the polymeric IBC located within the overpack.

Collar body 402 is a body shaped to follow at least a portion of an aperture formed in a manway of an overpack for an IBC according to an embodiment. In an embodiment, collar body 402 is curved to form a semi-circle such that a collar formed by joining multiple collar bodies 402 is sized to fit a circular aperture. In an embodiment, collar body 402 has a ring shape with a separation at one point along the ring, with the assembly projection 406*a* and the assembly socket 408*a* on opposing sides of the separation, forming a clamshell shape for a one-piece collar. In an embodiment, collar body 402 forms a half-circle. In an embodiment, collar body 402 forms a third or a quarter of a circle. In an embodiment, collar body 402 includes an angled portion having an angle corresponding to an angle that is formed in a shape of an aperture that the collar is to fit within.

Retention flange 404 extending outwards from the collar body 402. Retention flange 404 has a size and shape such that the collar including collar segment 400*a* cannot pass through the aperture where it is placed. Retention flange 404 can be a flat flange extending the length of collar body 402 and having the same general shape in plan view, for example being a semicircle extending from a semicircular collar body 402.

Assembly projection 406*a* is a projection from one end of the collar body 402. Assembly projection 406*a* is sized and shaped such that it can be mechanically joined to an assembly socket such as assembly socket 408*a*. The assembly projection 406*a* and the assembly socket can form an interference fit, a press-fit, or any other suitable joining to retain assembly projection 406*a* within the assembly socket.

Assembly socket 408*a* is a socket sized to receive an assembly projection such as assembly projection 406*a*. Assembly socket 408*a* can include features to form a mechanical connection with assembly projection 406*a*, such as having walls sized to form an interference fir or a press-fit with the assembly projection 408*a*. The assembly socket 408*a* can be at an end of collar body 402 that is opposite the end of collar body 402 where assembly projection 406*a* is located. In an embodiment, when assembly projections 406*a,b* are joined to assembly sockets 408*a,b*, mechanical, fasteners such as one or more screws can be used to secure the collar together. In an embodiment, the mechanical fasteners can be polymeric screws such as, as non-limiting examples, poly-ether-ether-ketone (PEEK) or polyvinylidine fluoride (PVDF). In an embodiment, the polymeric screws can include a fill material, such as, as a non-limiting example, 30% of a glass fill.

A vertical projection 410 extends from collar body 402. The vertical projection 410 can extend from the inner surface 412 of the collar body 402. Vertical projection 412 extends away from the plane of retention flange 404. The vertical projection can be positioned on collar body 402 and sized such that when a collar including collar segment 400*a* is placed at an aperture of an overpack, the vertical projection 410 extends through the aperture. The vertical projection 410 can prevent contact between a projection from a polymeric IBC and surfaces of the aperture.

Inner surface 412 is a surface of collar segment 400*a* facing inwards with respect to the shape defined by collar body 402. When a collar is assembled including collar segment 400*a*, and the collar is placed within an aperture of an overpack, the inner surface 412 is within the aperture and faces inwards within that aperture. In an embodiment, inner surface 412 contacts a projection of a polymeric IBC when a container including an overpack, the polymeric IBC, and the collar is assembled. Vertical projection 410 can extend from the inner surface 412 of the collar segment 400*a* such that an inwards-facing surface of vertical projection 410 is a continuation of the inner surface 412.

Groove 414 is formed in inner surface 412. Groove 414 can be positioned offset from the retention flange 404 such that when the collar is assembled and placed within an aperture of an overpack, that groove 414 is above retention flange 404 in the vertical direction. Groove 414 is sized such that it can accommodate seal 416, with a depth such that a seal can be formed between the collar and a projection of a polymeric IBC by the seal 416. The depth of groove 414 can be such that it allows at least a portion of seal 416 to protrude inwards from inner surface 412.

Seal 416 can be disposed in the grooves 414 of a collar formed from collar segments such as 400*a*. Seal 416 can be placed within the grooves 414 during or after assembly of the collar. Seal 416 can be, for example an O-ring or any other such suitable seal for forming a seal between the collar and a projection of a polymeric IBC. In an embodiment, seal 416 includes a polymer material. In an embodiment, the polymer material of seal 416 is chemically resistant. In an embodiment, the polymer material of seal 416 is a thermoplastic polymer material. In an embodiment, the polymer material of seal 416 is a fluoropolymer.

Figure 4B:
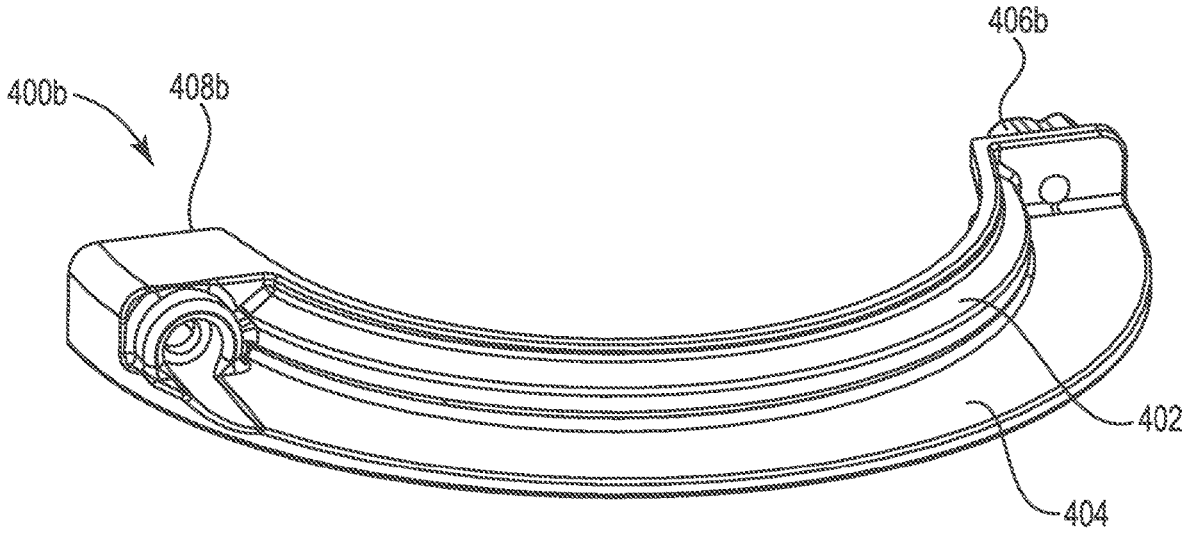
FIG. 4B shows a second view of a piece of a collar according to an embodiment.

FIG. 4B shows a second view of a second collar segment 400*b* according to an embodiment. As can be seen in FIG. 4B, when collar segments 400*a,b* are rotated 180 degrees with respect to one another, assembly projection 406*a* of the first collar segment 400*a* is opposite assembly socket 408*b* of the second collar segment 400*b*, and assembly projection 406*b* of the second collar segment 400*b* is opposite the assembly socket 408*a* of the first collar segment 400*a*. The pieces shown in FIGS. 4A and 4B can be joined to form a collar, by inserting assembly projection 406*a* into assembly socket 408*b*, and assembly projection 406*b* into assembly socket 406*a*. The assembly projections 406*a,b* and assembly sockets 408*a,b* can form a press-fit or any other suitable mechanical engagement to retain collar segments 400*a,b* to one another such that they form a continuous shape such as a ring.

When the collar segments 400*a,b* are joined, retention flange 404 can surround an aperture in a manway of an overpack according to an embodiment such that the retention flange provides mechanical interference preventing the collar from passing through the aperture. The vertical projection 410 can extend through the aperture, between the surface of the aperture and the surface of the polymeric IBC, preventing direct contact between the aperture and the polymeric IBC. The seal 416 can contact the projection of the polymeric IBC extending through the aperture, gripping that projection. The seal can be sized such that it cannot be pulled through the aperture when the collar is in place, retaining the projection within the manway.

Aspects:

It is understood that any of aspects 1-11 can be combined with any of aspects 12-20.

Aspect 1. An overpack comprising:

an overpack body having an open end, a closed end, and a lip surrounding the open end;

a cover including:

a plurality of apertures; and a manway surrounding the plurality of apertures, the manway including a domed lid, a cylindrical side wall, and a flow passage extending through the cylindrical side wall including a burst disk configured to release pressure above a predetermined pressure; and a plurality of collars, each collar including a first portion received within one of the plurality of apertures and a lip that is larger than the aperture receiving the collar.

Aspect 2. The overpack according to aspect 1, wherein the overpack body comprises a metal or metal alloy.

Aspect 3. The overpack according to any of aspects 1-2, wherein each of the plurality of collars comprises a plurality of pieces that form a continuous ring when joined together.

Aspect 4. The overpack according to any of aspects 1-3, wherein each of the collars comprises a polymer material having a static dry versus steel coefficient of friction of approximately 0.3 or less in accordance with ASTM D1894-140.

Aspect 5. The overpack according to any of aspects 1-4, wherein each of the collars includes a channel formed in an inner surface of the collar.

Aspect 6. The overpack according to aspect 5, further comprising a seal disposed in the channel of each of the collars.

Aspect 7. The overpack according to any of aspects 1-6, wherein each of the apertures has a chamfer, a bevel, or a rounded corner at the perimeter of the aperture.

Aspect 8. The overpack according to any of aspects 1-7, further comprising a spring-assisted hinge joining the domed lid to the cylindrical side wall of the manway.

Aspect 9. The overpack according to any of aspects 1-8, further comprising a first gasket disposed between the cover and the lip.

Aspect 10. The overpack according to any of aspects 1-9, further comprising a second gasket disposed between the domed lid and a top surface of the cylindrical side wall.

Aspect 11. The overpack according to any of aspects 1-10, wherein the predetermined pressure of the burst disk is at or about 9 psi.

Aspect 12. A container system comprising:

a polymeric intermediate bulk container (IBC) including:

an IBC body defining a storage space;

a plurality of projections at an end of the IBC body; and a port provided on each of the plurality of projections, the ports each in fluid communication with the storage space;

an overpack surrounding the polymeric IBC, the overpack including:

an overpack body having an open end, a closed end, and a lip surrounding the open end;

a cover including:

a plurality of apertures; and a manway surrounding the plurality of apertures, the manway including a domed lid, a cylindrical side wall, a flow passage extending through the cylindrical side wall including a burst disk configured to release pressure above a predetermined pressure; and a plurality of collars, each collar received within one of the plurality of apertures, wherein:

each of the projections extends through a corresponding one of each of the apertures such that each of the ports disposed on each projection is disposed within the cylindrical side wall of the manway, and each of the collars is disposed between an inner surface of a corresponding one of each the apertures and an outer surface of the projection extending through the aperture.

Aspect 13. The container system according to aspect 12, wherein the IBC body comprises a fluoropolymer.

Aspect 14. The container system according to any of aspects 12-13, further comprising a plurality of shock pads configured to contact both the IBC body and an inner surface of the main body of the overpack.

Aspect 15. The container system according to any of aspects 12-14, wherein at least one of the ports includes a port burst disc.

Aspect 16. The container system according to aspect 15, wherein the port burst disc is configured to release pressure at a pressure that is greater than the predetermined pressure of the overpack burst disc.

Aspect 17. The container system according to any of claims 15-16, wherein the port burst disc is configured to release pressure at a pressure that between approximately 15 psi and approximately 17 psi.

Aspect 18. The container system according to any of aspects 12-17, wherein: each of the collars includes a channel formed on an inner surface of said collar, and a seal disposed in each of the channels, wherein each of the seals contacts one of the projections of the polymeric IBC.

Aspect 19. The container system according to any of aspects 12-18, wherein each of the plurality of collars comprises a plurality of pieces that form a continuous ring when joined together.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. An overpack comprising:

an overpack body having an open end, a closed end, and a lip surrounding the open end;

a cover including:

a plurality of apertures; and a manway surrounding the plurality of apertures, the manway including a domed lid, a cylindrical side wall, and a fluid passage extending through the cylindrical side wall including a burst disk configured to release pressure above a predetermined pressure; and a plurality of collars, each collar including a first portion received within one of the plurality of apertures and a retention flange that is larger than the aperture receiving the collar.

2. The overpack of claim 1, wherein the overpack body comprises a metal or metal alloy.

3. The overpack of claim 1, wherein each of the plurality of collars comprises a plurality of pieces that form a continuous ring when joined together.

4. The overpack of claim 1, wherein each of the collars comprises a polymer material having a static dry versus steel coefficient of friction of approximately 0.3 or less in accordance with ASTM D1894-140.

5. The overpack of claim 1, wherein each of the collars includes a channel formed in an inner surface of the collar.

6. The overpack of claim 5, further comprising a seal disposed in the channel of each of the collars.

7. The overpack of claim 1, wherein each of the apertures has a chamfer, a bevel, or a rounded corner at the perimeter of the aperture.

8. The overpack of claim 1, further comprising a spring-assisted hinge joining the domed lid to the cylindrical side wall of the manway.

9. The overpack of claim 1, further comprising a first gasket disposed between the cover and the lip.

10. The overpack of claim 1, further comprising a second gasket disposed between the domed lid and a top surface of the cylindrical side wall.

11. The overpack of claim 1, wherein the predetermined pressure of the burst disk is at or about 9 psi.

12. A container system comprising:

a polymeric intermediate bulk container (IBC) including:

an IBC body defining a storage space;

a plurality of projections at an end of the IBC body; and a port provided on each of the plurality of projections, the ports each in fluid communication with the storage space;

an overpack surrounding the polymeric IBC, the overpack including:

an overpack body having an open end, a closed end, and a lip surrounding the open end;

a cover including:

a plurality of apertures; and a manway surrounding the plurality of apertures, the manway including a domed lid, a cylindrical side wall, a fluid passage extending through the cylindrical side wall including a burst disk configured to release pressure above a predetermined pressure; and a plurality of collars, each collar received within one of the plurality of apertures, wherein:

each of the projections extends through a corresponding one of each of the apertures such that each of the ports disposed on each projection is disposed within the cylindrical side wall of the manway, and each of the collars is disposed between an inner surface of a corresponding one of each the apertures and an outer surface of the projection extending through the aperture.

13. The container system of claim 12, wherein the IBC body comprises a fluoropolymer.

14. The container system of claim 12, further comprising a plurality of shock pads configured to contact both the IBC body and an inner surface of the main body of the overpack.

15. The container system of claim 12, wherein at least one of the ports includes a port burst disc.

16. The container system of claim 15, wherein the port burst disc is configured to release pressure at a pressure that is greater than the predetermined pressure of the overpack burst disc.

17. The container system of claim 15, wherein the port burst disc is configured to release pressure at a pressure that between approximately 15 psi and approximately 17 psi.

18. The container system of claim 12, wherein:

each of the collars includes a channel formed on an inner surface of said collar, and a seal disposed in each of the channels, wherein each of the seals contacts one of the projections of the polymeric IBC.

19. The container system of claim 12, wherein each of the plurality of collars comprises a plurality of pieces that form a continuous ring when joined together.

* * * * *